US009320088B2

(12) United States Patent
Laporte

(10) Patent No.: US 9,320,088 B2
(45) Date of Patent: Apr. 19, 2016

(54) LED-BASED LIGHTING UNITS WITH SUBSTANTIALLY SEALED LEDS

(75) Inventor: Jean-François Laporte, Laval (CA)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 15 days.

(21) Appl. No.: 13/816,959

(22) PCT Filed: Aug. 25, 2011

(86) PCT No.: PCT/IB2011/053735
§ 371 (c)(1),
(2), (4) Date: Feb. 14, 2013

(87) PCT Pub. No.: WO2012/029002
PCT Pub. Date: Mar. 8, 2012

(65) Prior Publication Data

US 2013/0147347 A1 Jun. 13, 2013

Related U.S. Application Data

(60) Provisional application No. 61/378,542, filed on Aug. 31, 2010.

(51) Int. Cl.

| | |
|---|---|
| ***H05B 33/02*** | (2006.01) |
| ***H05B 33/04*** | (2006.01) |
| ***F21V 5/00*** | (2015.01) |
| ***F21V 5/04*** | (2006.01) |
| ***F21V 17/16*** | (2006.01) |
| ***F21V 31/00*** | (2006.01) |

(Continued)

(52) U.S. Cl.
CPC ..... *H05B 33/04* (2013.01); *F21V 5/007* (2013.01); *F21V 5/04* (2013.01); *F21V 17/16* (2013.01); *F21V 31/005* (2013.01); *F21W 2131/10* (2013.01); *F21W 2131/103* (2013.01); *F21W 2131/1005* (2013.01); *F21Y 2101/02* (2013.01); *F21Y 2105/001* (2013.01)

(58) Field of Classification Search
CPC ..... F21V 31/005; F21V 5/007; H05B 33/02; H05B 33/04; H01L 33/48; H01L 33/52; H01L 33/3239
USPC ..... 362/239, 545; 313/512
See application file for complete search history.

(56) References Cited

U.S. PATENT DOCUMENTS

| | | | |
|---|---|---|---|
| 4,112,485 | A | 9/1978 | Sutter |
| 6,016,038 | A | 1/2000 | Mueller et al. |

(Continued)

FOREIGN PATENT DOCUMENTS

| | | | |
|---|---|---|---|
| CN | 2937778 | Y | 8/2007 |
| CN | 201339908 | Y | 11/2009 |

(Continued)

*Primary Examiner* — Karabi Guharay
(74) *Attorney, Agent, or Firm* — Meenakshy Chakravorty

(57) ABSTRACT

An LED-based lighting unit (10) with substantially sealed LEDS (30) is disclosed. The LED-based lighting unit (10) includes a plurality of LEDs (30)coupled to a mounting surface, a plurality of optical pieces (52) each placeable adjacent the mounting surface about at least one of the LEDs (30), and an elastomeric layer (60) abutting and extending between the optical pieces (52). Optionally, an adhesive layer (40) may be interposed between the mounting surface and the optical pieces (52) and/or the elastomeric layer (60). Optionally, a rigid layer (70) may be provided atop the elastomeric layer (60).

19 Claims, 7 Drawing Sheets

(51) Int. Cl.

| | |
|---|---|
| *F21W 131/10* | (2006.01) |
| *F21W 131/103* | (2006.01) |
| *F21Y 101/02* | (2006.01) |
| *F21Y 105/00* | (2006.01) |

(56) References Cited

U.S. PATENT DOCUMENTS

| | | | | |
|---|---|---|---|---|
| 6,211,626 | B1 | 4/2001 | Lys et al. | |
| 6,461,017 | B2 | 10/2002 | Selkee | |
| 6,520,669 | B1 * | 2/2003 | Chen et al. | 362/545 |
| 7,458,703 | B2 | 12/2008 | Han et al. | |
| 7,490,954 | B2 | 2/2009 | Mayer et al. | |
| 2005/0258446 | A1 | 11/2005 | Raos et al. | |
| 2008/0220549 | A1 | 9/2008 | Nall et al. | |
| 2009/0207602 | A1 | 8/2009 | Reed et al. | |
| 2009/0298376 | A1 | 12/2009 | Guillien et al. | |
| 2009/0310356 | A1 | 12/2009 | Laporte | |
| 2010/0046223 | A1 * | 2/2010 | Li et al. | 362/249.02 |

FOREIGN PATENT DOCUMENTS

| | | | |
|---|---|---|---|
| EP | 1909336 | A1 | 4/2008 |
| JP | 2004111284 | A | 4/2004 |
| WO | 2008137109 | A1 | 11/2008 |

* cited by examiner

LED-BASED LIGHTING UNITS WITH SUBSTANTIALLY SEALED LEDS

TECHNICAL FIELD

The present invention is directed generally to an LED-based lighting unit. More particularly, various inventive methods and apparatus disclosed herein relate to an LED-based lighting unit having a plurality of LEDs that are substantially sealed from the external environment.

BACKGROUND

Digital lighting technologies, i.e. illumination based on semiconductor light sources, such as light-emitting diodes (LEDs), offer a viable alternative to traditional fluorescent, HID, and incandescent lamps. Functional advantages and benefits of LEDs include high energy conversion and optical efficiency, durability, lower operating costs, and many others. Recent advances in LED technology have provided efficient and robust full-spectrum lighting sources that enable a variety of lighting effects in many applications. Some of the fixtures embodying these sources feature a lighting module, including one or more LEDs capable of producing different colors, e.g. red, green, and blue, as well as a processor for independently controlling the output of the LEDs in order to generate a variety of colors and color-changing lighting effects, for example, as discussed in detail in U.S. Pat. Nos. 6,016,038 and 6,211,626, incorporated herein by reference.

Lighting fixtures employing LED light sources are often designed so as to provide ingress protection for one or more aspects of the optical system of the lighting fixtures. Ingress protection generally refers to the degree of protection provided from certain undesirable external objects such as solid foreign objects (e.g., dust, pollen) and/or liquids (e.g., water). For example, in some LED-based lighting fixtures, the LEDs may be sealed from undesirable external objects. Also, for example, in some LED lighting fixtures, other electrical components (e.g., the circuit board to which the LEDs are coupled) and/or other components of the optical system of the lighting fixtures may also optionally be sealed from undesirable external objects.

In some LED-based lighting fixtures, the LEDs and other components of the optical system may be enclosed in a housing having a transparent or translucent glass portion substantially sealed over an opening in the housing. The housing and the translucent glass portion collectively provide a degree of ingress protection to the optical system and are often the only form of ingress protection provided. Although such lighting fixtures may provide a degree of ingress protection, the sealing aspects thereof may be prone to damage, expensive, too numerous, may undesirably alter the light output of one or more of the LEDs, may prevent convenient access to the interior of the housing, and/or may present other drawbacks. In other LED lighting fixtures a transparent resin is applied directly on the LEDs to provide a degree of ingress protection for the LEDs. Although such LED lighting fixtures may provide ingress protection for the LEDs, the resin thereof may undesirably alter one or more light output characteristics of the LEDs, may be difficult to accurately apply, may not appropriately protect other electrical components of the optical system, and/or may present other drawbacks.

Thus, there is a need in the art to provide an improved LED-based lighting unit that has a plurality of LEDs substantially sealed from the external environment and that may optionally address one or more of the aforementioned drawbacks.

SUMMARY

The present disclosure is directed to inventive methods and apparatus for an LED-based lighting unit having a plurality of LEDs substantially sealed from the external environment. For example, the LED-based lighting unit may include a mounting surface and a plurality of LEDs coupled to the mounting surface. A plurality of optical pieces may also be provided that each have a base adjacent the mounting surface about at least one LED of the plurality of LEDs. The LED-based lighting unit may also include an elastomeric layer that abuts and extends between the optical pieces. The elastomeric layer and the optical pieces may function to cooperatively substantially seal the plurality of LEDs from the external environment. An adhesive layer may optionally be interposed between the optical pieces and the mounting surface and/or the elastomeric layer and the mounting surface. Also, a rigid layer may optionally be provided atop the elastomeric layer and/or a portion of the optical pieces. When provided, the rigid layer may cooperate with the mounting surfaces to compress the optical pieces and/or the elastomeric layer.

Generally, in one aspect, an LED-based lighting unit having a mounting surface is provided. The LED-based lighting unit includes a plurality of LEDs, an adhesive layer, a plurality of optical pieces, and an elastomeric layer. The LEDs are coupled to the mounting surface and each of the LEDs has a light emitting portion. The adhesive layer is atop the mounting surface and is not in contact with the light emitting portion of at least some of the LEDs. The optical pieces each have a base in contact with the adhesive layer about at least one LED of the plurality of LEDs. At least some of the optical pieces are individually placeable about at least one LED. The elastomeric layer is in contact with the adhesive layer and abuts and extends between the optical pieces. The LED-based lighting unit is configured to substantially seal the LEDs from external objects.

In some embodiments the elastomeric layer extends beyond and lips over the periphery of the mounting surface.

In some embodiments each of the optical pieces is individually placeable about at least one LED.

In some embodiments the elastomeric layer abuts the entirety of the base of each of the optical pieces.

In some embodiments the LED-based lighting unit further includes a rigid layer atop the elastomeric layer. In versions of those embodiments the rigid layer overlaps a portion of the optical pieces. In versions of those embodiments the rigid layer and the mounting surface collectively provide compressive force on at least one of the elastomeric layer and the optical pieces. In versions of those embodiments the rigid layer extends beyond and lips over the periphery of the elastomeric layer.

Generally, in another aspect an LED-based lighting unit having a mounting surface is provided. The LED-based lighting unit includes a plurality of LEDs, a plurality of optical pieces, an elastomeric layer, and a rigid layer. The LEDs are coupled to the mounting surface and each of the LEDs has a light emitting portion. The optical pieces each have a base adjacent the mounting surface about at least one LED of the LEDs. The elastomeric layer extends between the optical pieces and abuts and surrounds the base of each of the optical pieces. The rigid layer is atop the elastomeric layer and atop a portion of each of the optical pieces. The rigid layer overlaps the abutment between the base of each of the optical pieces and the elastomeric layer. The LED-based lighting unit is configured to substantially seal the LEDs from external objects.

In some embodiments an adhesive layer is interposed between the base of the optical pieces and the mounting surface.

In some embodiments an adhesive layer is interposed between the elastomeric layer and the mounting surface.

In some embodiments the rigid layer and the mounting surface collectively provide compressive force on at least one of the elastomeric layer and the optical pieces. In versions of those embodiments the rigid layer and the mounting surface collectively provide compressive force on the elastomeric layer and on the optical pieces.

In some embodiments the elastomeric layer extends beyond and lips over the periphery of the mounting surface.

In some embodiments the elastomeric layer is substantially planar with a surface of the base of each of the optical pieces proximal its abutment therewith.

Generally, in another aspect an LED-based lighting unit having a mounting surface is provided. The LED-based lighting unit includes a plurality of LEDs, a plurality of optical pieces, an elastomeric layer, and a rigid layer. The LEDs are coupled to the mounting surface and each of the LEDs has a light emitting portion. The optical pieces each have a base adjacent the mounting surface about at least one LED of the LEDs. The elastomeric layer abuts and extends between the optical pieces. The rigid layer is atop the elastomeric layer and atop a portion of each of the optical pieces. The rigid layer overlaps the abutment between each of the optical pieces and the elastomeric layer and the rigid layer and the mounting surface collectively provide compressive force on at least one of the elastomeric layer and the optical pieces.

In some embodiments an adhesive layer is interposed between the elastomeric layer and the mounting surface.

In some embodiments an adhesive layer is interposed between the base of the optical pieces and the mounting surface. In some versions of those embodiments an adhesive layer is interposed between the elastomeric layer and the mounting surface.

In some embodiments at least one of the optical pieces includes an off-axis reflecting prism.

As used herein for purposes of the present disclosure, the term "LED" should be understood to include any electroluminescent diode or other type of carrier injection/junction-based system that is capable of generating radiation in response to an electric signal. Thus, the term LED includes, but is not limited to, various semiconductor-based structures that emit light in response to current, light emitting polymers, organic light emitting diodes (OLEDs), electroluminescent strips, and the like. In particular, the term LED refers to light emitting diodes of all types (including semi-conductor and organic light emitting diodes) that may be configured to generate radiation in one or more of the infrared spectrum, ultraviolet spectrum, and various portions of the visible spectrum (generally including radiation wavelengths from approximately 400 nanometers to approximately 700 nanometers). Some examples of LEDs include, but are not limited to, various types of infrared LEDs, ultraviolet LEDs, red LEDs, blue LEDs, green LEDs, yellow LEDs, amber LEDs, orange LEDs, and white LEDs (discussed further below). It also should be appreciated that LEDs may be configured and/or controlled to generate radiation having various bandwidths (e.g., full widths at half maximum, or FWHM) for a given spectrum (e.g., narrow bandwidth, broad bandwidth), and a variety of dominant wavelengths within a given general color categorization.

For example, one implementation of an LED configured to generate essentially white light (e.g., a white LED) may include a number of dies which respectively emit different spectra of electroluminescence that, in combination, mix to form essentially white light. In another implementation, a white light LED may be associated with a phosphor material that converts electroluminescence having a first spectrum to a different second spectrum. In one example of this implementation, electroluminescence having a relatively short wavelength and narrow bandwidth spectrum "pumps" the phosphor material, which in turn radiates longer wavelength radiation having a somewhat broader spectrum.

It should also be understood that the term LED does not limit the physical and/or electrical package type of an LED. For example, as discussed above, an LED may refer to a single light emitting device having multiple dies that are configured to respectively emit different spectra of radiation (e.g., that may or may not be individually controllable). Also, an LED may be associated with a phosphor that is considered as an integral part of the LED (e.g., some types of white LEDs). In general, the term LED may refer to packaged LEDs, non-packaged LEDs, surface mount LEDs, chip-on-board LEDs, T-package mount LEDs, radial package LEDs, power package LEDs, LEDs including some type of encasement and/or optical element (e.g., a diffusing lens), etc.

The term "light source" should be understood to refer to any one or more of a variety of radiation sources, including, but not limited to, LED-based sources (including one or more LEDs as defined above), incandescent sources (e.g., filament lamps, halogen lamps), fluorescent sources, phosphorescent sources, high-intensity discharge sources (e.g., sodium vapor, mercury vapor, and metal halide lamps), lasers, other types of electroluminescent sources, pyro-luminescent sources (e.g., flames), candle-luminescent sources (e.g., gas mantles, carbon arc radiation sources), photo-luminescent sources (e.g., gaseous discharge sources), cathode luminescent sources using electronic satiation, galvano-luminescent sources, crystallo-luminescent sources, kine-luminescent sources, thermo-luminescent sources, triboluminescent sources, sonoluminescent sources, radioluminescent sources, and luminescent polymers.

A given light source may be configured to generate electromagnetic radiation within the visible spectrum, outside the visible spectrum, or a combination of both. Hence, the terms "light" and "radiation" are used interchangeably herein. Additionally, a light source may include as an integral component one or more filters (e.g., color filters), lenses, or other optical components. Also, it should be understood that light sources may be configured for a variety of applications, including, but not limited to, indication, display, and/or illumination. An "illumination source" is a light source that is particularly configured to generate radiation having a sufficient intensity to effectively illuminate an interior or exterior space. In this context, "sufficient intensity" refers to sufficient radiant power in the visible spectrum generated in the space or environment (the unit "lumens" often is employed to represent the total light output from a light source in all directions, in terms of radiant power or "luminous flux") to provide ambient illumination (i.e., light that may be perceived indirectly and that may be, for example, reflected off of one or more of a variety of intervening surfaces before being perceived in whole or in part).

The term "lighting fixture" is used herein to refer to an implementation or arrangement of one or more lighting units in a particular form factor, assembly, or package. The term "lighting unit" is used herein to refer to an apparatus including one or more light sources of same or different types. A given lighting unit may have any one of a variety of mounting arrangements for the light source(s), enclosure/housing arrangements and shapes, and/or electrical and mechanical connection configurations. Additionally, a given lighting unit optionally may be associated with (e.g., include, be coupled to and/or packaged together with) various other components (e.g., control circuitry) relating to the operation of the light source(s). An "LED-based lighting unit" refers to a lighting unit that includes one or more LED-based light sources as discussed above, alone or in combination with other non LED-based light sources. A "multi-channel" lighting unit refers to an LED-based or non LED-based lighting unit that includes at least two light sources configured to respectively generate different spectrums of radiation, wherein each different source spectrum may be referred to as a "channel" of the multi-channel lighting unit.

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein. It should also be appreciated that terminology explicitly employed herein that also may appear in any disclosure incorporated by reference should be accorded a meaning most consistent with the particular concepts disclosed herein.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION

LED lighting fixtures have been designed that enclose the LEDs in a housing having a transparent or translucent glass portion that is substantially sealed over an opening in the housing. The housing and the glass portion collectively provide a degree of ingress protection to the LEDs. LED lighting fixtures have also been designed that enclose LEDs in a transparent or translucent resin to provide a degree of ingress protection to the LEDs. Although such lighting fixtures may provide ingress protection, they suffer from one or more drawbacks. For example, sealing aspects thereof may be prone to damage, expensive, too numerous, difficult to apply, may undesirably alter the light output of one or more of the LEDs, and/or may prevent convenient access to the interior of the housing and/or the optical system. Thus, Applicants have recognized and appreciated that there is a need in the art to provide an improved LED-based lighting unit that has a plurality of LEDs substantially sealed from the external environment and that may optionally address one or more of the aforementioned drawbacks.

More generally, Applicants have recognized and appreciated that it would be beneficial to provide a LED-based lighting that utilizes at least a plurality of optical pieces each provided about at least one LED and an elastomeric layer extending between the optical pieces in order to substantially seal the LEDs from the external environment.

In view of the foregoing, various embodiments and implementations of the present invention are directed to a LED-based lighting unit that includes a mounting surface, a plurality of LEDs coupled to the mounting surface, a plurality of optical pieces each about at least one LED of the plurality of LEDs, and an elastomeric layer that abuts and extends between the optical pieces. The elastomeric layer and the optical pieces may function to cooperatively substantially seal the plurality of LEDs from the external environment. An adhesive layer may optionally be interposed between the optical pieces and the mounting surface and/or the elastomeric layer and the mounting surface. Also, a rigid layer may optionally be provided atop the elastomeric layer and/or a portion of the optical pieces.

Figure 1:
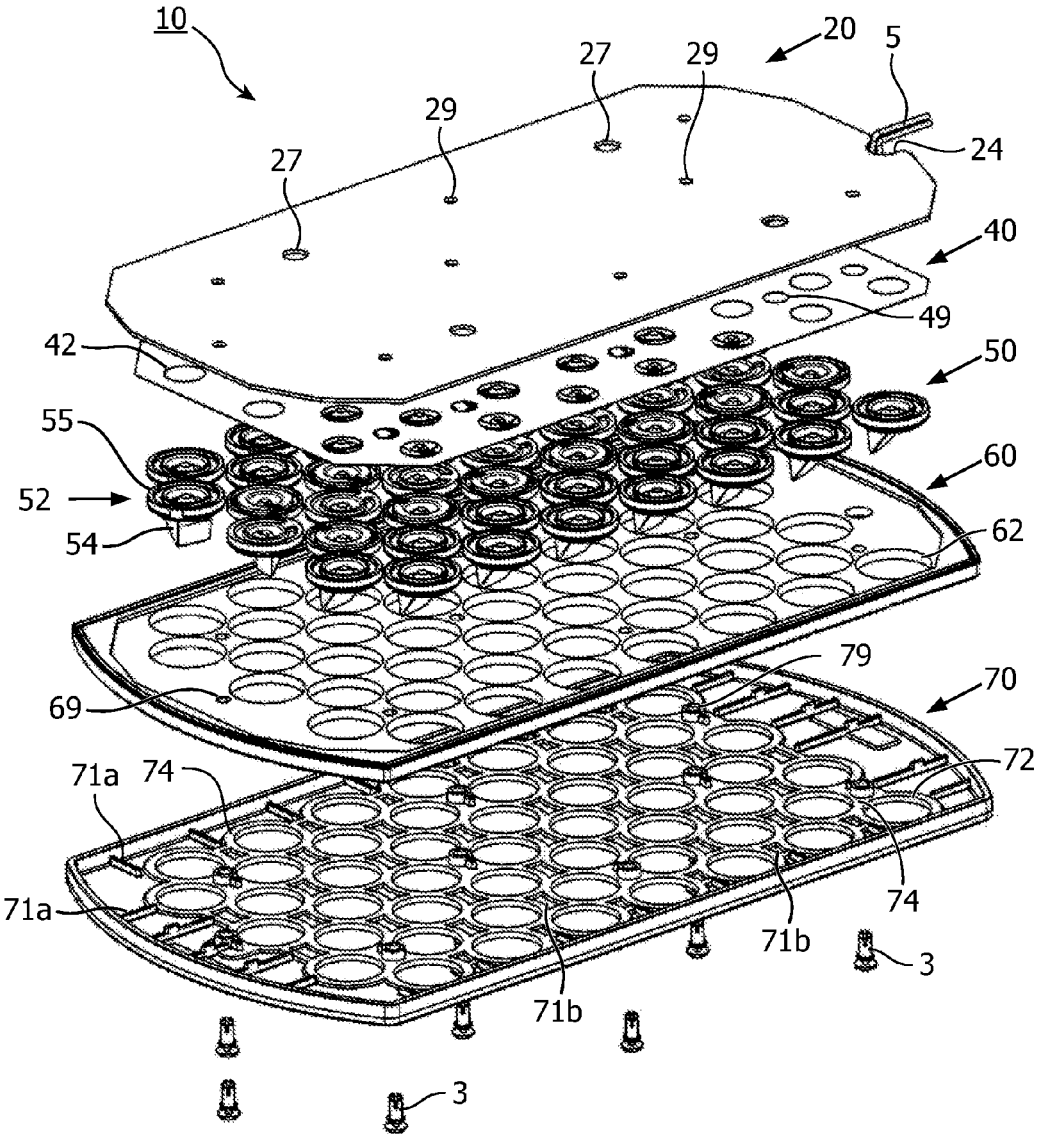
FIG. 1 illustrates a bottom exploded perspective view of an embodiment of a LED-based lighting unit with substantially sealed LEDs.

Referring to FIG. 1, an embodiment of an LED-based lighting unit 10 includes an LED board 20, an adhesive layer 40, a bank 50 of optical pieces 52, an elastomeric layer 60, and a rigid layer 70, which are shown from a bottom perspective view exploded away from each other in FIG. 1. As described in additional detail herein, in alternative embodiments the LED-based lighting unit 10 may optionally be provided without one or more elements depicted and described herein. For example, in some embodiments the rigid layer 70 and/or the adhesive layer 40 may be omitted.

Figure 2:
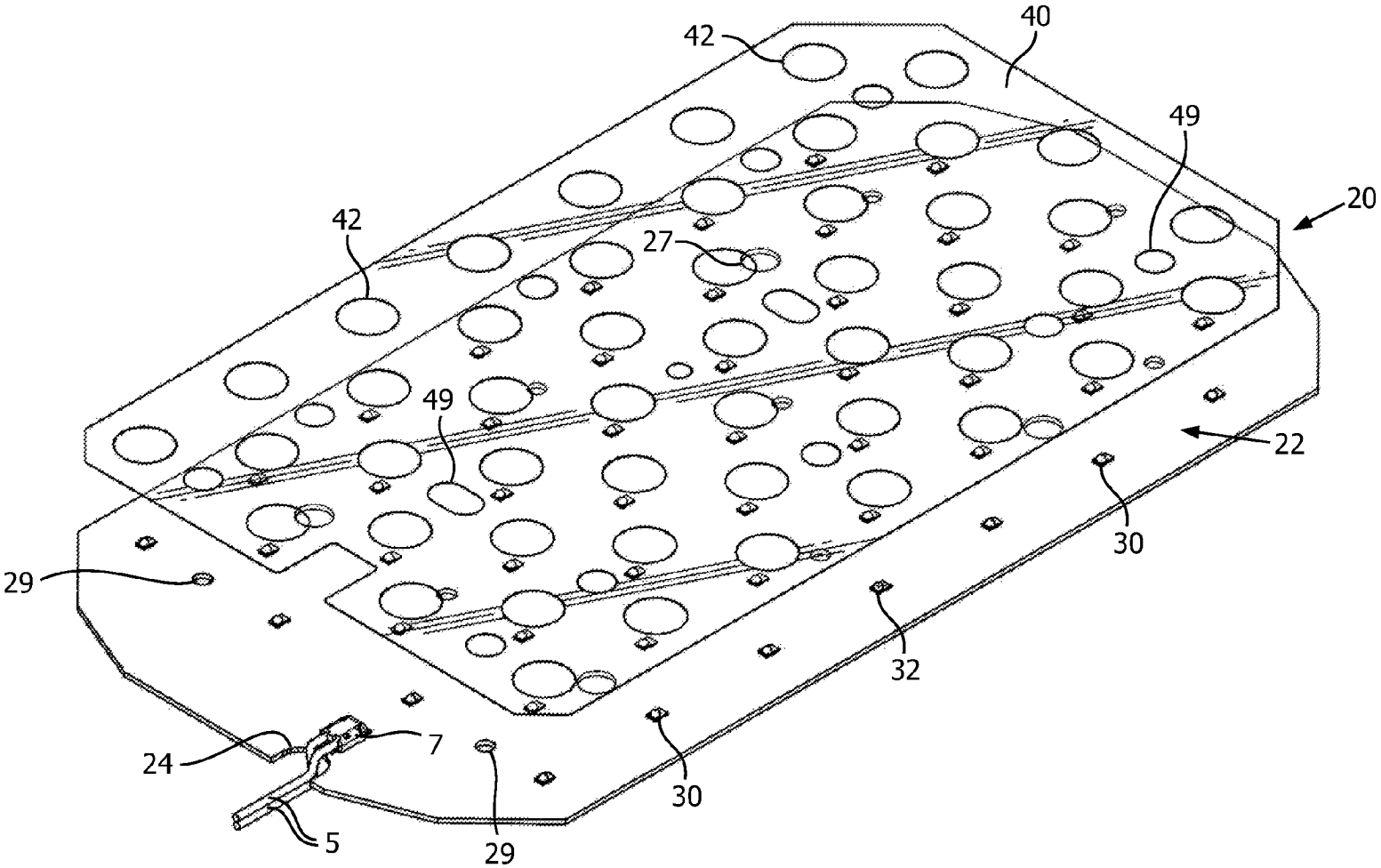
FIG. 2 illustrates a top perspective view of a mounting surface, LEDs, and an adhesive layer of the LED-based lighting unit of FIG. 1; the adhesive layer is shown exploded away from the mounting surface.
Figure 3:
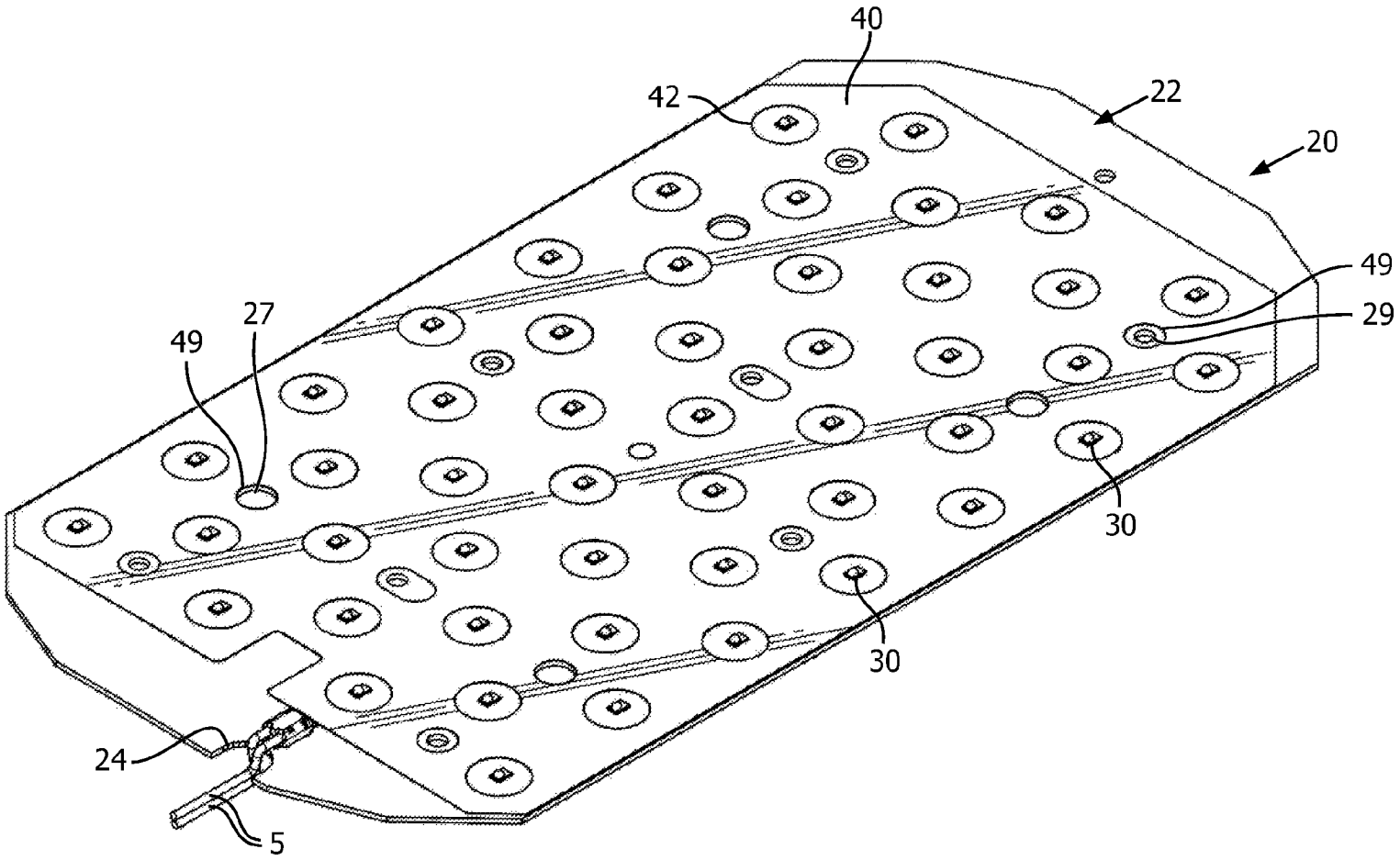
FIG. 3 illustrates a top perspective view of the mounting surface, the LEDs, and the adhesive layer of the LED-based lighting unit of FIG. 1; the adhesive layer is shown atop the mounting surface.

Referring to FIG. 2 and FIG. 3, a top perspective view of the LED board 20 and the adhesive layer 40 are depicted. The adhesive layer 40 is shown exploded away from the LED board 20 in FIG. 2 and is shown coupled atop a mounting surface 22 of the LED board 20 in FIG. 3. The adhesive layer 40 is depicted as being substantially transparent in FIG. 2 and FIG. 3 to provide a better view of other aspects of the LED-based lighting unit 10. It is understood that while adhesive layer 40 may be transparent in some embodiments, it may also be translucent or opaque in other embodiments. Forty-nine LEDs 30 are provided on the mounting surface 22. Each of the LEDs 30 contains a light emitting portion 32 through which light is emitted from the LED 30. An electrical connection 7 is in electrical connectivity with and selectively provides power to the LEDs 30 via electrical wiring 5 which may be selectively electrically connected to a power source. The electrical wiring 5 extends from electrical connection 7 and through a notch 24 in the LED board 20. In some embodiments the adhesive layer 40 may be VHB™ double sided tape available from 3M™.

The LED board 20 includes a plurality of fastener openings 29 that align with certain of fastener openings 49 of the adhesive layer 40 when the adhesive layer 40 is coupled to the mounting surface 22. As described in additional detail herein, the fastener openings 29 and 49 enable fasteners 3 (FIG. 1, FIG. 6, FIG. 7) to extend therethrough for coupling the elastomeric layer 60 and/or the rigid layer 70 to the LED board 20. The adhesive layer 40 also includes a plurality of LED openings 42 that are aligned with LEDs 30 when the adhesive layer 40 is coupled to the mounting surface 22. Accordingly, the adhesive layer 40 will surround and not be in contact with the LEDs 30 when coupled to the mounting surface 22.

The LED board 20 also includes a plurality of second fastener openings 27 that align with certain of fastener opening 49 of the adhesive layer 40 when the adhesive layer 40 is coupled to the mounting surface 22. The second fastener openings 27 may optionally enable fasteners to extend therethrough to couple the LED board 20 to a housing or other structure. The second fastener openings 27 may alternatively be coupled to bosses that extend rearwardly from the LED board 20 to thereby couple the LED board 20 to a housing or other structure. Alternative methods and/or structure may be utilized to coupled LED board 20 and/or other portions of LED-based lighting unit 10 to a housing or other structure when implementing LED-based lighting unit 10 into a lighting fixture. In some embodiments LED board 20 may be a metal core printed circuit board such as, for example, an aluminum core printed circuit board.

Although a specific LED board 20 and arrangement of LEDs 30 is illustrated and described herein, one of ordinary skill in the art, having had the benefit of the present disclosure will recognize that alternative LED support structures incorporating an LED mounting surface may be utilized in alternative embodiments. For example, in some embodiments the LED support structure may be non-planar, may be alternatively shaped, and/or may comprise a plurality of individual LED support structures such as a plurality of LED boards. Moreover, an alternative number and/or arrangement of LEDs 30 may be provided. For example, more or fewer LEDs may be provided, one or more of the LEDs may be provided in a different LED package, the LEDs may be provided in a non-symmetrical arrangement, and/or the LEDs may be non-planar with respect to one another. Also, although a specific adhesive layer 40 is illustrated and described herein, one of ordinary skill in the art, having had the benefit of the present disclosure will recognize that alternative adhesive layers may be provided. For example, in alternative embodiments the adhesive layer may be provided in multiple sheets, may be provided with differently placed openings therethrough, or may not be provided in sheet form (e.g., may be applied in liquid form or gel form). Moreover, in some embodiments of the LED-based lighting unit the adhesive layer 40 may be omitted.

Figure 4:
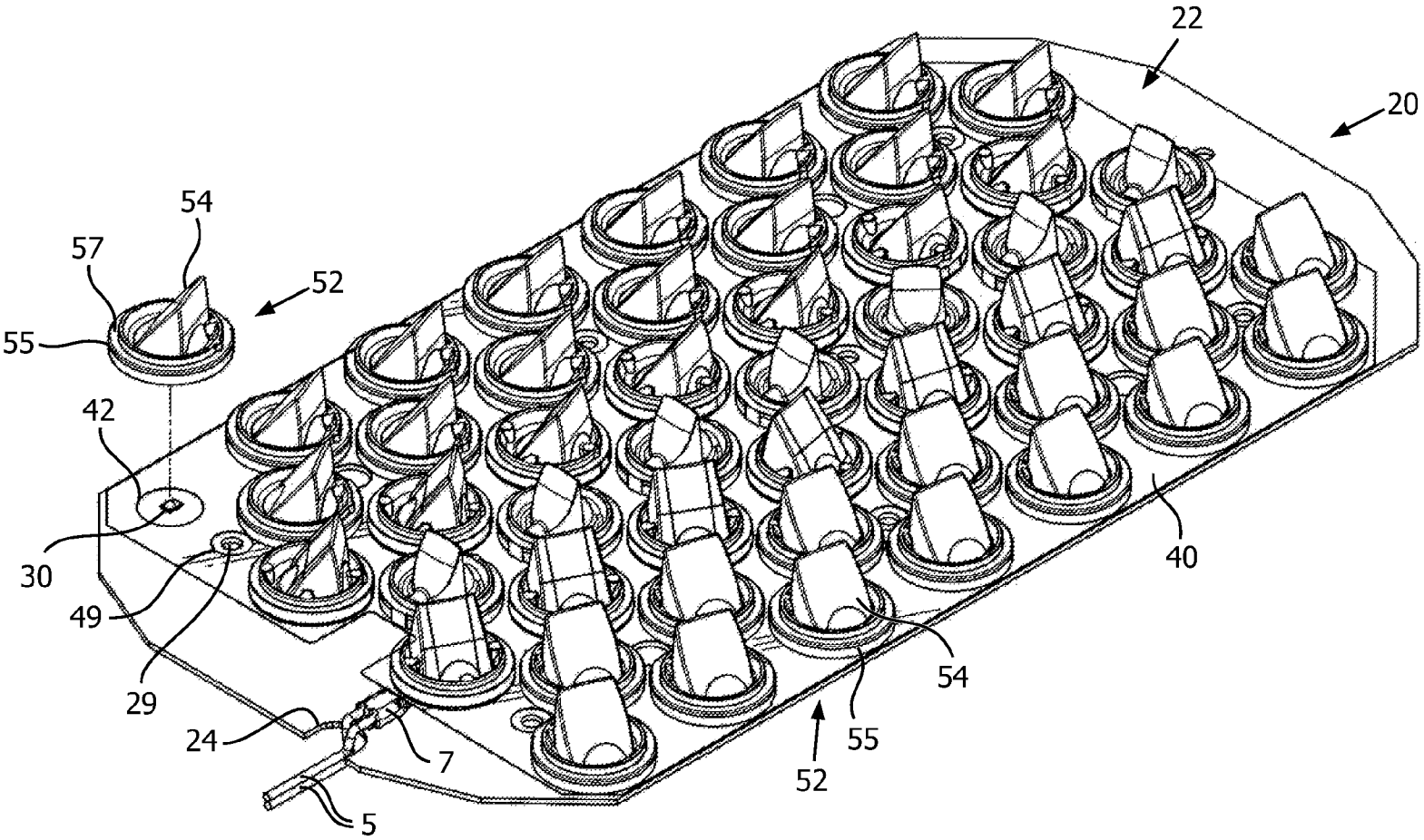
FIG. 4 illustrates a top perspective view of the mounting surface, the LEDs, the adhesive layer, and optical pieces of the LED-based lighting unit of FIG. 1; a plurality of the optical pieces are placed about the LEDs in contact with the adhesive layer; one of the optical pieces is shown exploded away from one of the LEDs.

Referring to FIG. 4, a top perspective view of the LED board 20, the adhesive layer 40, and the bank 50 of optical pieces 52 are illustrated. The bank 50 includes forty-nine optical pieces 52. Forty-eight of the optical pieces 52 are each illustrated placed over and about a single LED 30 and in contact with the adhesive layer 40. One of the optical pieces 54 is shown exploded away from one of the LEDs 30 and the adhesive layer 40. Each of the optical pieces 52 includes a base 55 that is at least partially in contact with and adhesively coupled to the adhesive layer 40 when the optical piece 52 is placed over and about one of the LEDs 30. The base 55 includes a top surface 57 that is substantially planar in the illustrated embodiment. Each of the optical pieces 52 also includes a reflecting prism 54 coupled to and extending away from the base 55. The depicted optical pieces 52 are configured to collimate light emitted by a single of the LEDs 30 toward a face of the reflecting prism 54. The face of the reflecting prism then redirects a substantial majority of the collimated light directed thereto in a general direction that is off-axis with respect to a primary light output axis of the single of the LEDs 30. When the optical pieces 52 are placed about the LEDs 30, the LEDs 30 are substantially enclosed by the LED board 20 and the optical pieces 52. In some embodiments the optical pieces 52 may be LifeLED™ optical pieces available from Philips Lumec.

Although specific optical pieces 52 are described in detail herein, it is understood that alternative optical pieces may be utilized in the LED-based lighting unit described herein. For example, in alternative embodiments optical pieces may be provided that do not redirect light output from the LEDs in a direction that is generally off-axis with respect to a primary LED axis. Also, for example, in alternative embodiments non-collimating optical pieces may be provided. Also, for example, in alternative embodiments optical pieces may be provided that may be placed over and about more than one of LEDs 30. Also, for example, in alternative embodiments one or more optical pieces may be coupled to one another. Also, for example, in alternative embodiments optical pieces may be provided with alternative base configurations such as, for example, alternatively shaped bases, alternatively sized bases, and/or bases with non-planar top surfaces. Moreover, it is understood that a single LED-based lighting unit may combine a plurality of uniquely configured optical pieces therein.

Figure 5:
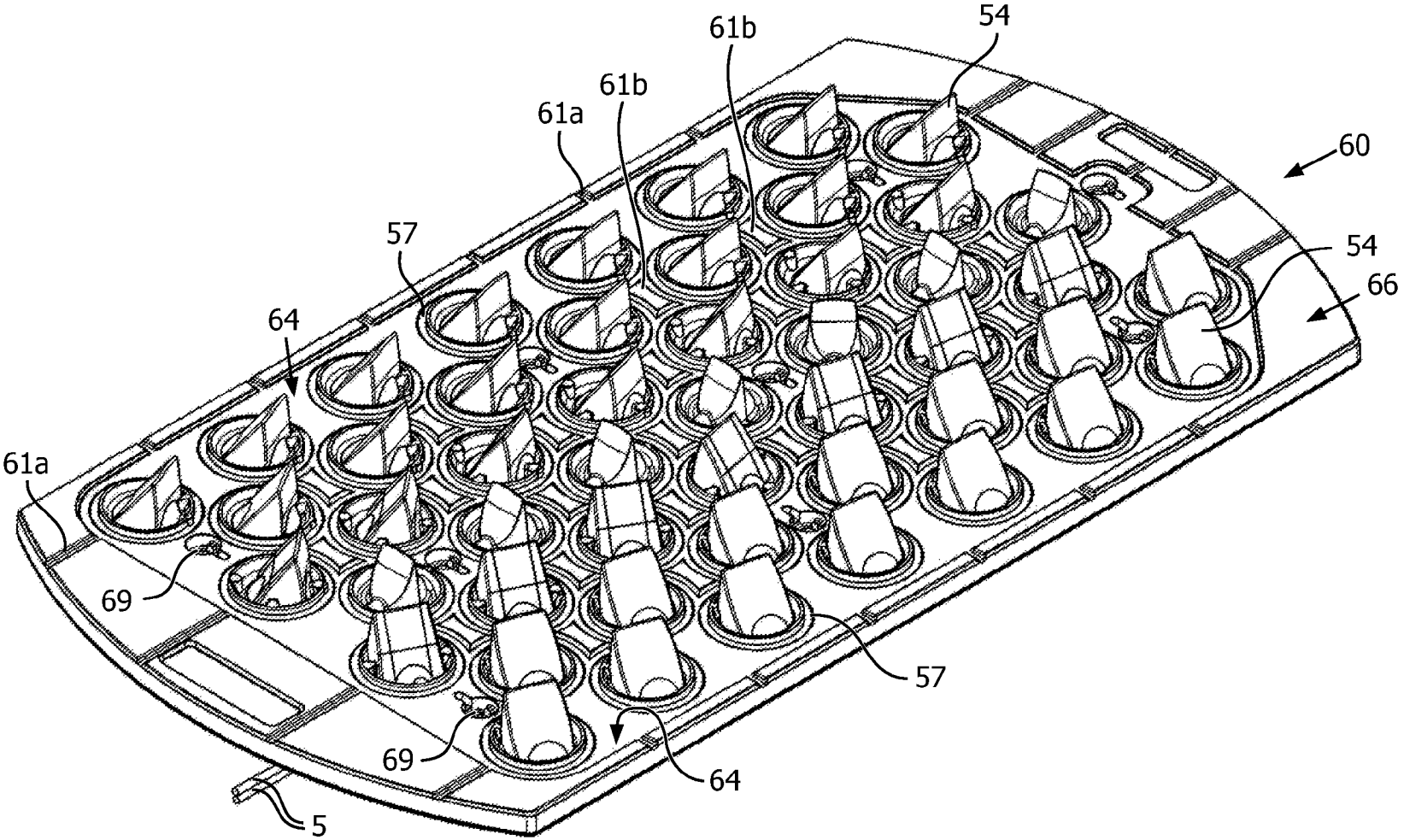
FIG. 5 illustrates a top perspective view of the optical pieces and the elastomeric layer of the LED-based lighting unit of FIG. 1; the optical pieces are placed about the LEDs in contact with the adhesive layer; the elastomeric layer abuts and extends between the optical pieces and is in contact with the adhesive layer.

Referring to FIG. 5, an elastomeric layer 60 is shown placed atop the LED board 20, the adhesive layer 40, and the bank 50 of optical pieces 52 illustrated in FIG. 4. The elastomeric layer 60 includes a plurality of optical piece openings 62 (FIG. 1) for enabling at least a portion of optical pieces 52 to extend therethrough. As described in additional detail herein, the elastomeric layer 60 abuts and extends between the optical pieces 52 and is at least partially atop and in contact with the adhesive layer 40. The elastomeric layer 60 includes a plurality of fastener openings 69 that align with fastener openings 29 of the LED board 20 and fastener openings 49 of the adhesive layer 40 when the elastomeric layer 60 is placed atop the adhesive layer 40 and the LED board 20. The fastener openings 69 enable fasteners 3 to extend therethrough for coupling the elastomeric layer 60 to the LED board 20. The elastomeric layer 60 includes a recess area 64 that abuts the bases 55 of optical pieces 52 and is substantially planar with the top surface 57 of the bases 55. As described in additional detail herein, the elastomeric layer 60 extends beyond and lips over the periphery of the LED board 20. In some embodiments the elastomeric layer 60 may have a durometer measurement of 40 A or less. In some embodiments the elastomeric layer 60 may have a durometer measurement within the range of approximately 40 A to approximately 80 A. In some embodiments the elastomeric layer may be a thermoplastic elastomer (TPE). In some embodiments the elastomeric layer may be Santoprene™ available from Exxon Mobile Chemical.

The elastomeric layer 60 also includes a plurality of protrusions 61*b* that extend upwardly from the recess area 64. The protrusions 61*b* are sized and positioned so as to be received in corresponding recesses 71*b* (FIG. 1) of the rigid layer 70. The protrusions 61*b* and recesses 71*b* may optionally assist in appropriately aligning rigid layer 70 with respect to elastomeric layer 60 and may optionally be in engagement fit with one another. The elastomeric layer 60 also includes a plurality of recesses 61*a* that are recessed with respect to at least some of a surrounding upper surface 66 of elastomeric layer 60. The recesses 61A are sized and positioned so as to receive corresponding protrusions 71A (FIG. 1) of rigid layer 70. The recesses 61*a* and protrusions 71*a* may optionally assist in appropriately aligning rigid layer 70 with respect to elastomeric layer 60 and may optionally be in engagement fit with one another.

Although specific elastomeric layer 60 is described herein, it is understood that alternative elastomeric layers may be utilized in the LED-based lighting unit described herein. For example, in alternative embodiments the elastomeric layer 60 may be provided in multiple pieces, may be provided with alternatively placed openings therethrough, with alternatively shaped openings therethrough, with differing alignment structure, and/or without alignment structure.

Figure 6:
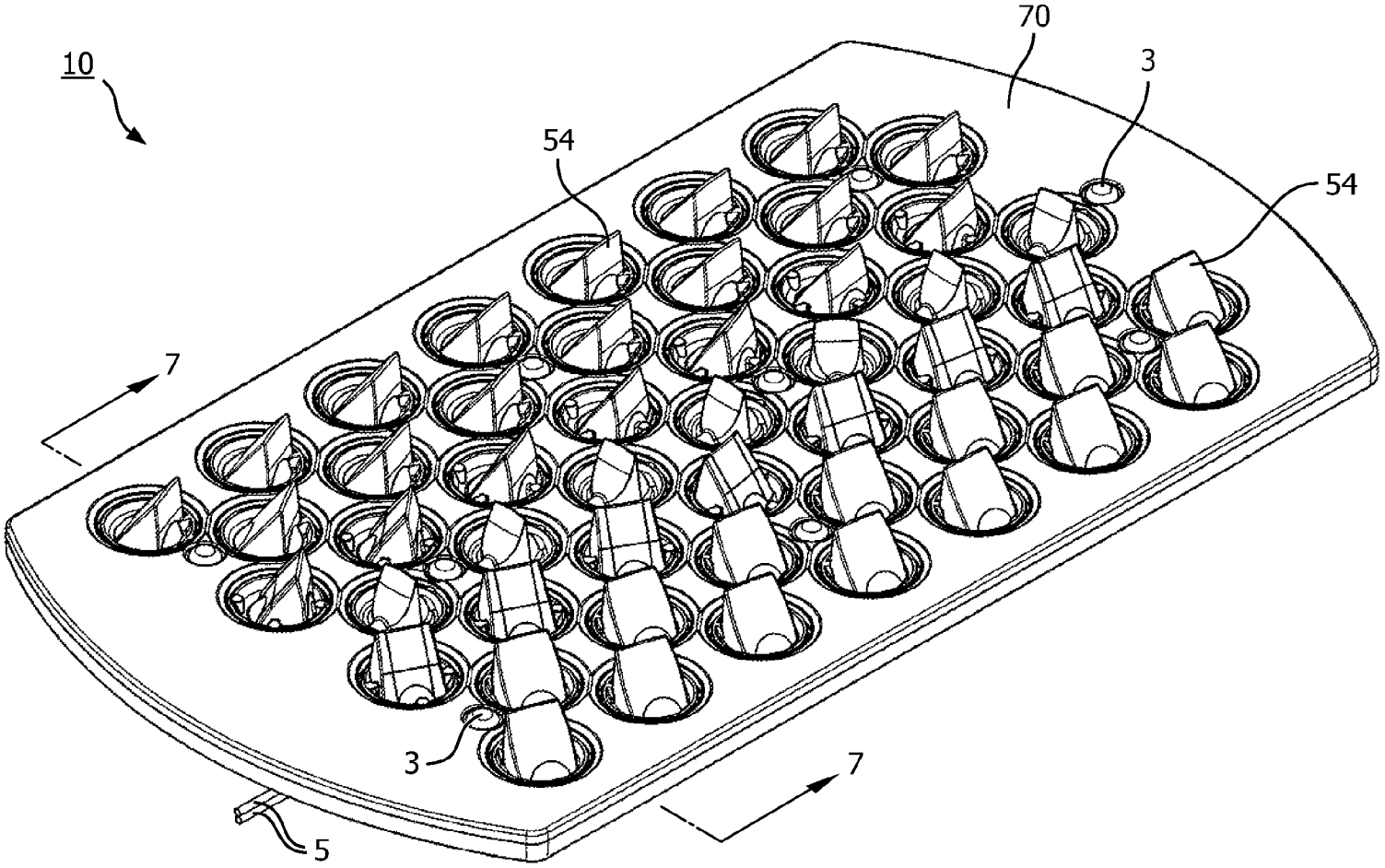
FIG. 6 illustrates a top perspective view of the rigid layer and the optical pieces of the LED-based lighting unit of FIG. 1; the rigid layer is atop the elastomeric layer and is atop a portion of the optical pieces.

FIG. 6 illustrates a top perspective view of the rigid layer 70 placed atop the LED board 20, the adhesive layer 40, the bank 50 of optical pieces 52, and the elastomeric layer 60 illustrated in FIG. 5. The rigid layer 70 includes a plurality of optical piece openings 72 (FIG. 1) for enabling at least a portion of optical pieces 52 to extend therethrough. As described in additional detail herein, the rigid layer 70 is atop the elastomeric layer 60 and extends over the abutment between elastomeric layer 60 and optical pieces 52. The rigid layer 70 includes a plurality of fastener openings 79 (FIG. 1) that align with fastener openings 69 of the elastomeric layer 60, fastener openings 29 of the LED board 20 and fastener openings 49 of the adhesive layer 40 when the rigid layer 70 is placed atop the elastomeric layer 60, the adhesive layer 40, and the LED board 20. The fastener openings 79 enable fasteners 3 to extend therethrough for coupling the rigid layer 70 to the LED board 20. As described in additional detail herein, the rigid layer 70 extends beyond and lips over the periphery of the elastomeric layer 60 and also extends beyond the periphery of the LED board 20. In some embodiments the rigid layer 70 may optionally comprise polycarbonate or aluminum. Optionally, the rigid layer 70 may be painted.

Figure 7:
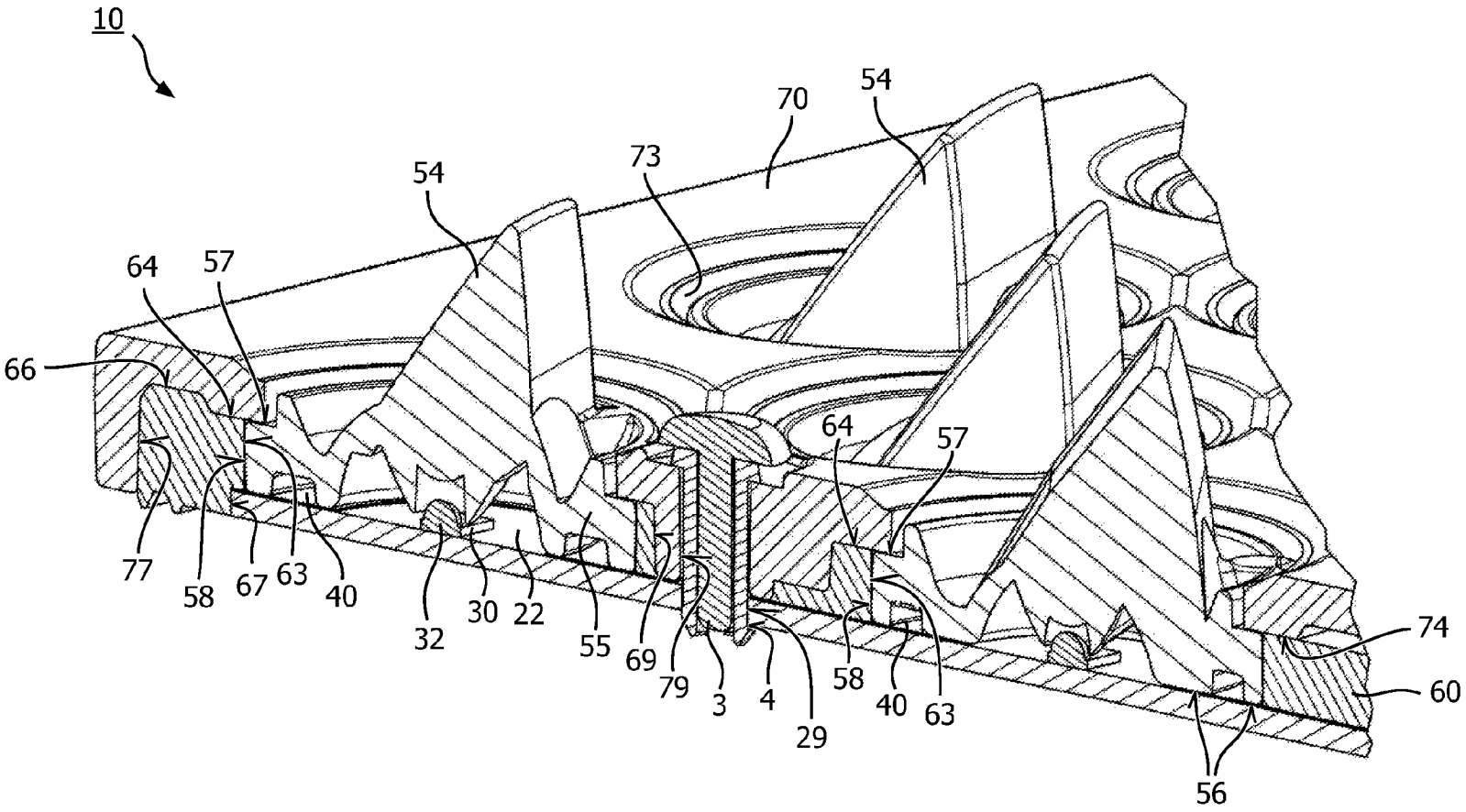
FIG. 7 illustrates a section view of the LED-based lighting unit taken along the section line 7-7 of FIG. 6.

Referring to FIG. 7, a section view of the LED-based lighting unit 10 taken along the section line 7-7 of FIG. 6 is illustrated. A contacting surface 56 of optical pieces 52 is shown in contact with the adhesive layer 40 (visible in section as the darker line atop the mounting surface 22). It can also be seen that portions of the elastomeric layer 60 are in contact with the adhesive layer 40. The contacting surface 56 surrounds the LED 30 and LED light emitting portion 32. The base 55 of the optical pieces 52 includes a side 58 that abuts a wall 63 defining optical piece openings 62 of elastomeric layer 60. The side 58 and the wall 63 may be in interference fit with one another. As illustrated in FIG. 7, in the depicted embodiment the recess area 64 of the elastomeric layer 60 is substantially planar with the top surface 57 of the base 55. A chamfered portion of the elastomeric layer 60 extends between the recess area 64 and a top surface 66 of the elastomeric layer 60.

The rigid layer 70 includes an overlap portion 74 that is provided atop both the recess area 64 and a portion of the top surface 57. Each of the optical piece openings 72 includes a wall 73 defining the optical piece opening 72 and a chamfered portion extending between the wall 73 and a top surface of the rigid layer 70. The optical piece openings 72 of the rigid layer 70 are of a smaller diameter than the optical piece openings 62 of the elastomeric layer 60 and of are of a smaller diameter than the side 58 of the base 55, thereby causing the rigid layer 70 to overlap the abutment between the elastomeric layer 60 and the base 55. A lip portion 67 of the elastomeric layer 60 is visible in FIG. 7 and lips over the LED board 20. A lip portion 77 of the rigid layer 70 is also visible in FIG. 7 and lips over the elastomeric layer 60.

A single fastener 3 is visible in FIG. 7 and is surrounded by opening 79 through rigid layer 70, opening 69 through elastomeric layer 60 and opening 29 through LED board 20. The fastener 3 may be a push lock fastener and includes chamfered portions 4 for lockingly engaging a portion of the LED board 20. When inserted through opening 79 and opening 29 and locked into place, the chamfered portions 4 may engage the LED board 20 and a head portion of the fastener 3 may engage a portion of the rigid layer 70. The fastener 3 may provide compressive force to compress the optical piece 52 and/or the elastomeric layer 60 between the rigid layer 70 and the LED board 20. In alternative embodiments other fasteners and/or alternative structure may be utilized to affix the rigid layer 70 and/or the elastomeric layer 60 to the LED board 20. For example, in some embodiments a threaded fastener may be received in a boss formed in or coupled to opening 69, opening 79, and/or opening 29. Also, for example, clamps may be provided that contact exteriorly facing surfaces of elastomeric layer 60 or rigid layer 70 and LED board 20. One of ordinary skill in the art, having had the benefit of the present disclosure, will recognize that other structure and/or methodology may be utilized to affix the rigid layer 70 and/or the elastomeric layer 60.

Although specific rigid layer 70 is described herein, it is understood that alternative rigid layers may be utilized in the LED-based lighting unit described herein and in some embodiments of the LED-based lighting unit the rigid layer 70 may be omitted. For example, in alternative embodiments the rigid layer 70 may be provided in multiple pieces, may be provided with alternatively placed openings therethrough, with alternatively shaped openings therethrough, with differing alignment structure, and/or without alignment structure.

The LED-based lighting unit 10 may be incorporated into a lighting fixture such as, for example, an outdoor lighting fixture. Optionally, the LED-based lighting unit 10 may be incorporated into a housing that includes a light output opening. In some embodiments the light output opening may be lens-free and portions of the LED-based lighting unit 10 (e.g., rigid layer 70 and optical pieces 52; elastomeric layer 60 and optical pieces 52) may be exposed to the external environment. Optionally, the rigid layer 70 and/or the elastomeric layer 60 may interface with other portions of a lighting fixture to substantially seal a rear surface of the LED board 20 from the exterior environment. Optionally, the rear surface of the LED board 20 may be substantially free of electrical components and/or may not be readily susceptible to damage by certain exterior elements.

While several inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

What is claimed is:

1. An LED-based lighting unit having a mounting surface and comprising:

a plurality of LEDs coupled to said mounting surface, each of said LEDs having a light emitting portion;

an adhesive layer atop said mounting surface, said adhesive layer not in contact with said light emitting portion of at least some of said LEDs;

a plurality of optical pieces each having a base in contact with said adhesive layer about at least one LED of said plurality of LEDs, at least some of said optical pieces individually placeable about said at least one LED; and an elastomeric layer in contact with said adhesive layer and abutting and extending between said optical pieces;

wherein said LED-based lighting unit is configured to substantially seal said LEDs from external objects by cooperative sealing engagement of the elastomeric layer and the optical pieces, wherein said elastomeric layer extends beyond and lips over the periphery of said mounting surface.

2. The LED-based lighting unit of claim 1, wherein each of said optical pieces is individually placeable about said at least one LED.

3. The LED-based lighting unit of claim 1, wherein said elastomeric layer abuts the entirety of said base of each of said optical pieces.

4. The LED-based lighting unit of claim 1, further comprising a rigid layer atop said elastomeric layer.

5. The LED-based lighting unit of claim 4, wherein said rigid layer overlaps a portion of said optical pieces.

6. The LED-based lighting unit of claim 5, wherein said rigid layer and said mounting surface collectively provide compressive force on at least one of said elastomeric layer and said optical pieces.

7. The LED-based lighting unit of claim 5, wherein said rigid layer extends beyond and lips over the periphery of said elastomeric layer.

8. An LED-based lighting unit having a mounting surface and comprising:

a plurality of LEDs coupled to said mounting surface, each of said LEDs having a light emitting portion;

a plurality of optical pieces each having a base adjacent said mounting surface about at least one LED of said LEDs;

an elastomeric layer extending between said optical pieces and abutting and surrounding said base of each of said optical pieces;

a rigid layer atop said elastomeric layer and atop a portion of each of said optical pieces;

wherein said rigid layer overlaps the abutment between each said base and said elastomeric layer; and wherein said LED-based lighting unit is configured to substantially seal said LEDs from external objects by the elastomeric layer and the optical pieces, wherein an adhesive layer is interposed between said elastomeric layer and said mounting surface.

9. The LED-based lighting unit of claim 8, wherein an adhesive layer is interposed between said base of said optical pieces and said mounting surface.

10. The LED-based lighting unit of claim 8, wherein said rigid layer and said mounting surface collectively provide compressive force on at least one of said elastomeric layer and said optical pieces.

11. The LED-based lighting unit of claim 10, wherein said rigid layer and said mounting surface collectively provide compressive force on said elastomeric layer and on said optical pieces.

12. The LED-based lighting unit of claim 8, wherein said elastomeric layer is substantially planar with a surface of said base of each of said optical pieces proximal its abutment therewith.

13. An LED-based lighting unit having a mounting surface and comprising:

a plurality of LEDs coupled to said mounting surface, each of said LEDs having a light emitting portion;

a plurality of optical pieces each having a base adjacent said mounting surface about at least one LED of said LEDs;

an elastomeric layer extending between said optical pieces and abutting and surrounding said base of each of said optical pieces;

a rigid layer atop said elastomeric layer and atop a portion of each of said optical pieces;

wherein said rigid layer overlaps the abutment between each said base and said elastomeric layer; and wherein said LED-based lighting unit is configured to substantially seal said LEDs from external objects by the elastomeric layer and the optical pieces, wherein an adhesive layer is interposed between said elastomeric layer and said mounting surface; and wherein said elastomeric layer extends beyond and lips over the periphery of said mounting surface.

14. An LED-based lighting unit having a mounting surface and comprising:

a plurality of LEDs coupled to said mounting surface, each of said LEDs having a light emitting portion;

a plurality of optical pieces each having a base adjacent said mounting surface about at least one LED of said LEDs;

an elastomeric layer abutting and extending between said bases of said optical pieces;

a rigid layer atop said elastomeric layer and atop a portion of each of said optical pieces;

wherein said rigid layer overlaps the abutment between each of said optical pieces and said elastomeric layer; and wherein said rigid layer and said mounting surface collectively provide compressive force on at least one of said elastomeric layer and said optical pieces to seal the LEDs from the environment.

15. The LED-based lighting unit of claim 14, wherein an adhesive layer is interposed between said elastomeric layer and said mounting surface.

16. The LED-based lighting unit of claim 14, wherein an adhesive layer is interposed between said base of said optical pieces and said mounting surface.

17. The LED-based lighting unit of claim 16, wherein an adhesive layer is interposed between said elastomeric layer and said mounting surface.

18. The LED-based lighting unit of claim 14, wherein at least one of said optical pieces includes an off-axis reflecting prism.

19. An LED-based lighting unit having a mounting surface and comprising:

a plurality of LEDs coupled to said mounting surface, each of said LEDs having a light emitting portion;

a plurality of optical pieces each having a base adjacent said mounting surface about at least one LED of said LEDs;

an elastomeric layer extending between said optical pieces and abutting and surrounding said base of each of said optical pieces;

a rigid layer atop said elastomeric layer and atop a portion of each of said optical pieces; wherein said rigid layer overlaps the abutment between each said base and said elastomeric layer; and wherein said LED-based lighting unit is configured to substantially seal said LEDs from external objects, wherein said elastomeric layer is substantially planar with a surface of said base of each of said optical pieces proximal its abutment therewith.

* * * * *